United States Patent [19]

Rehkemper et al.

[11] Patent Number: 4,881,733

[45] Date of Patent: Nov. 21, 1989

[54] BALLOON POPPING MECHANISM

[75] Inventors: Steven Rehkemper; Denni Rivette, both of Chicago, Ill.

[73] Assignee: C&S Distributing Co., Santa Monica, Calif.

[21] Appl. No.: 167,575

[22] Filed: Mar. 14, 1988

[51] Int. Cl.[4] ..... A63F 9/00

[52] U.S. Cl. ..... 273/1 R; 446/223; 446/220; 272/27 N; 273/138 R

[58] Field of Search ..... 446/220, 221, 222, 223, 446/226; 273/1 R, 138 R, 1 E; 272/27 N; 30/347, 276

[56] References Cited

U.S. PATENT DOCUMENTS

| | | | |
|---|---|---|---|
| 2,792,670 | 5/1957 | Haynes | 30/347 X |
| 3,204,369 | 9/1965 | Green | 446/397 X |
| 3,608,903 | 9/1971 | Cooper et al. | 446/220 X |
| 3,685,825 | 8/1972 | Dorazio | 273/1 R |
| 3,795,400 | 3/1974 | Glass et al. | 446/220 X |
| 3,848,357 | 11/1974 | Morrison | 446/223 |
| 3,861,684 | 1/1975 | Gastin et al. | 273/1 R X |
| 4,092,798 | 6/1978 | Oquita | 446/5 |
| 4,113,261 | 9/1978 | Sims et al. | 273/249 |
| 4,169,593 | 10/1979 | Wood | 446/220 X |

*Primary Examiner*—Mickey Yu

*Attorney, Agent, or Firm*—Laff, Whitesel, Conte & Saret

[57] ABSTRACT

A toy including an expandable article together with a device which punctures the article at random or predetermined time intervals. The toy of the invention can be tossed so as to actuate a device for puncturing an expandable article retained in the toy. The actuation of the device for puncturing the expandable article imparts a highly exciting and amusing aspect to play with the toy. In one embodiment, a motor diven wheel having at least one teeth thereon is rotated to puncture the article.

7 Claims, 3 Drawing Sheets

BALLOON POPPING MECHANISM

This invention relates to amusement devices and games and more particularly to means for and methods of carrying on simple games.

People of all ages like to play games and to use devices for their mutual amusement. However, they also dislike the bother of having to learn many complicated rules. For example, children often have short attention spans, and depending on their stage of development, past experiences and the like, rules may be difficult to learn. Adults may not have the patience or desire to study anything which is too complicated or distracting from the enjoyment of a sociable occasion. For family, enjoyment of games and devices should be simple enough for the children and enjoyable enough for the adults.

Games such as hot potato, the egg toss, or spin the bottle are stale and therefore of minimum interest. If an effort is made to develop entirely new games and devices, it may be more of a bother than it is worth to learn them. If the games or devices are not sufficiently different, they are not fun to play. Thus, most people tend to prefer games and devices with which they are already at least somewhat familiar.

Accordingly, an object of the invention is to provide new and improved games and amusement devices. In particular, an object is to provide an exciting new amusement device for playing a game for which the rules may be already known to the participants.

In keeping with an aspect of the invention, these and other objects are accomplished by an amusement toy for puncturing an expandable, elastic article, such as a bladder or balloon, which can be filled with air, gas, water, foam or other substance capable of expanding the unpressurized article. Hereafter, this article shall be referred to as the "expandable article". More particularly, the toy includes a means for puncturing the expandable article at random or predetermined time intervals. The participants pass the toy from hand-to-hand and try not to be the one holding the toy when it is punctured. The expandable article can be retained in the toy by a holder which may be in the form of a human face, an animal, or any other desired form.

The invention has several embodiments for puncturing the expandable article at random time intervals. One embodiment includes an enclosed container having a spring biased shaft member therein which is retained within the container by a support member attached to the interior of the container. A weighted component included within the interior of the container generates random impacts to cause the shaft member to puncture the expandable article. In a second embodiment, the expandable article is punctured at random time intervals by a spring driven member having an elongated arm which is movable to a position beyond the exterior of a container for puncturing the expandable article. In a further embodiment, the expandable article is punctured at random or predetermined time intervals by a rotating wheel apparatus. The wheel can be rotated by a suitable motor means. In yet another embodiment, the expandable article is punctured by a swinging arm mounted for pEndulum action.

Embodiments of the invention for accomplishing these and other objects are shown in the attached drawings wherein.

Figure 1:
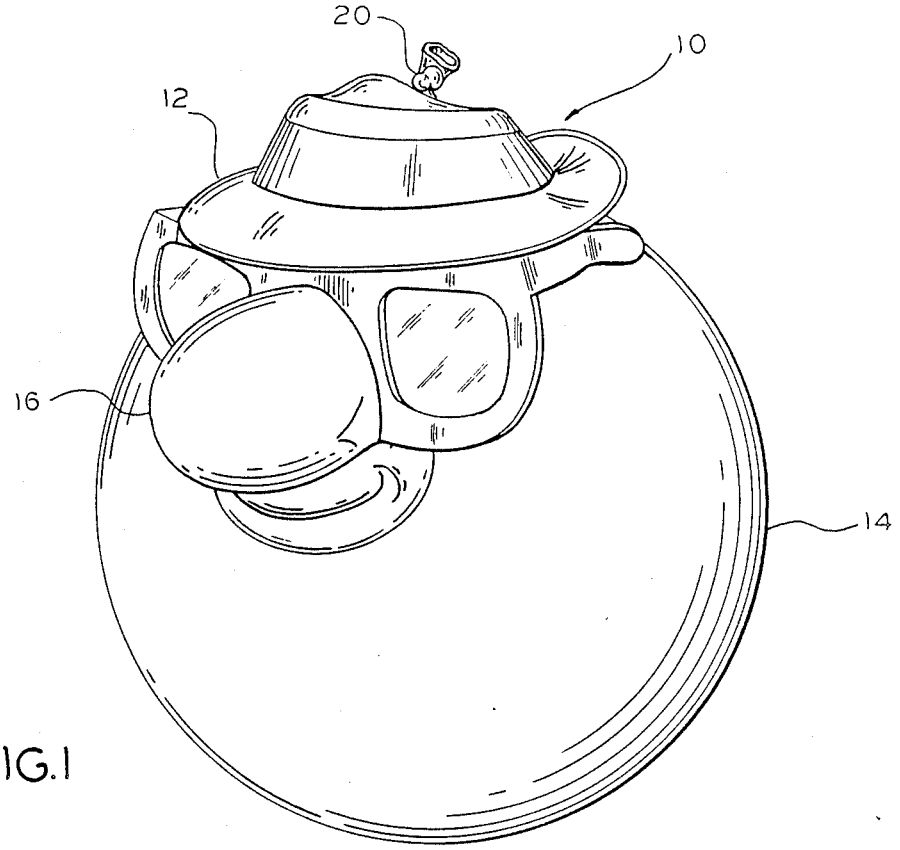
FIG. 1 is a perspective view of an exemplary toy having an expandable article therein.

FIG. 1 is a perspective view of the inventive toy 10 including a holder 12 for retaining an expandable object, here shown as balloon 14. Holder 12 may be a molded plastic part, for example. The holder 12 may take any suitable form, it being shown here in the form of a human face, with the balloon forming the head. A portion 16 of the holder (here the nose) includes a means for puncturing the balloon after a random or predetermined interval of time. The toy 10 may be used in a game wherein a number of people toss or pass the toy from person to person. The object is to not be the one holding the toy when the balloon is punctured.

In some embodiments the puncturing means is constructed in such a manner that it is less likely to break the balloon if the toy is caught in a particular manner. Therefore, there is an element of skill which may be developed to add interest without requiring any effort to learn game rules or procedures.

Figure 2:
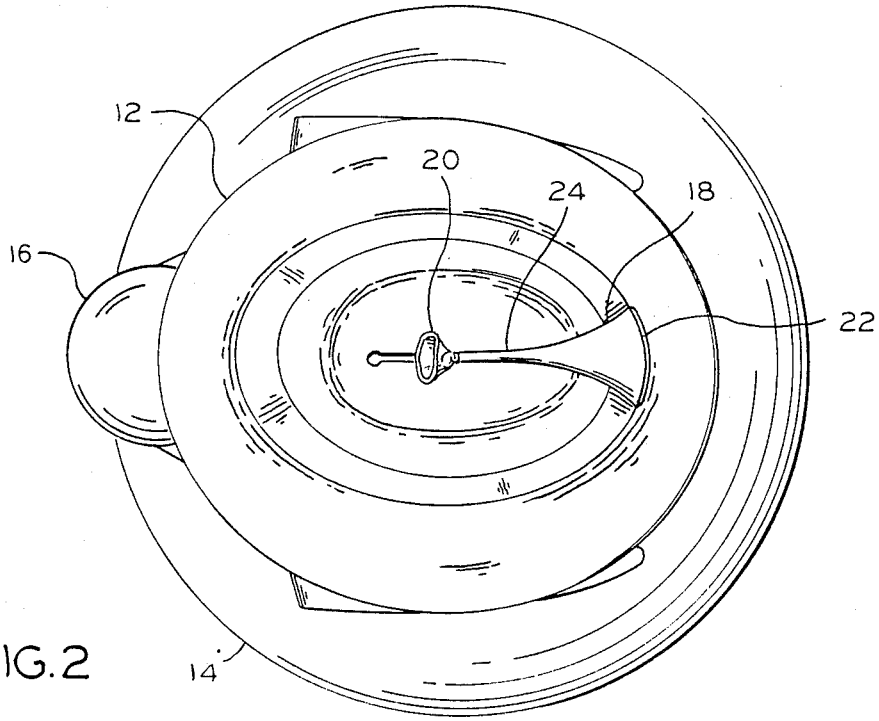
FIG. 2 is a top plan view of the toy of FIG. 1.

In FIG. 2, the holder 12 is seen in plan view looking down on the top of the hat in FIG. 1. A key hole slot 18 is formed in the holder 12 so that the tied end 20 (FIG. 1) of the balloon may be passed through a large end 22 and slid into a capture position in the small end 24 of slot 18.

Figure 3:
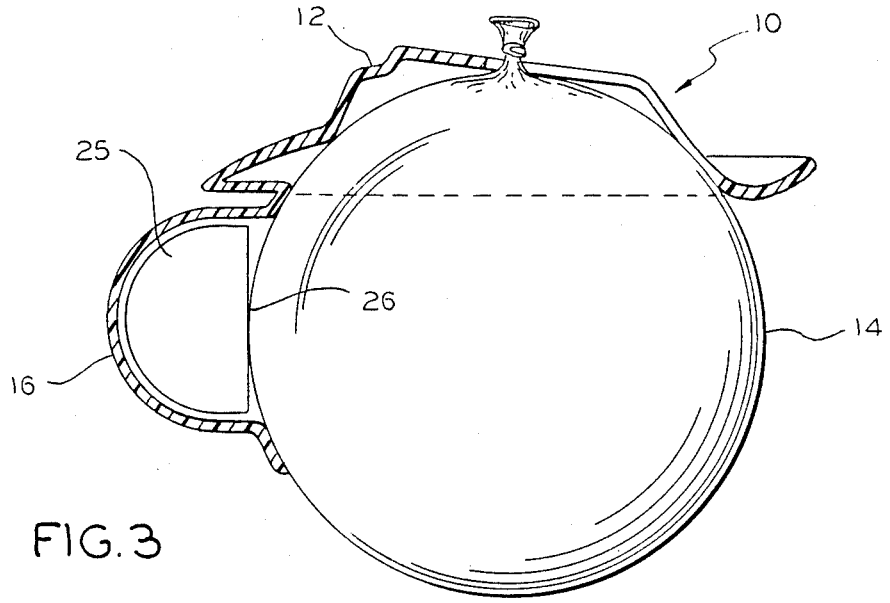
FIG. 3 is a cross section of the toy of the invention showing an expandable article and a device for puncturing the article.
Figure 3A:
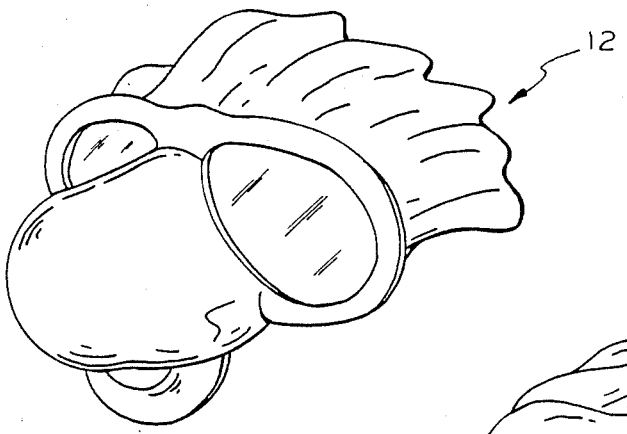
FIG. 3A is a front view of the toy of FIG. 2 in the shape of a human face.
Figure 3B:
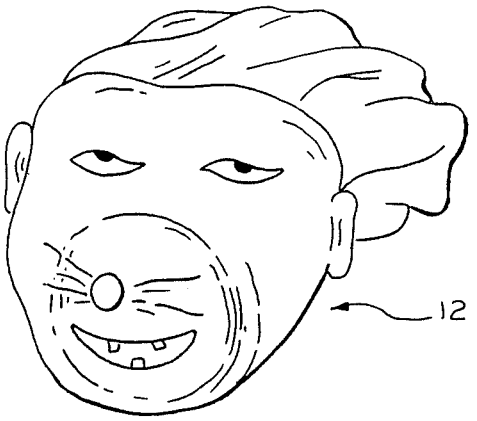
FIG. 3B is a front view of the toy of FIG. 2 in the shape of an animal.

FIG. 3 shows a cross section of the inventive toy 10. The toy of the invention includes a puncturing device 25 within the holder, such as, for example, in nose position 16. Holder 12 may be any configuration that can retain the expandable article 14 and the puncturing device 25 in sufficiently close proximity to insure that device 25 will in fact puncture the article. Preferably, article 14 touches device 25 at surface 26 of the device 25. The configuration of holder 12, as shown in FIG. 3A, may be in the form of a human face. Alternatively, holder 12 may, as shown in FIG. 3B, be in the form of an animal. Obviously, still other forms may be used.

Figure 4:
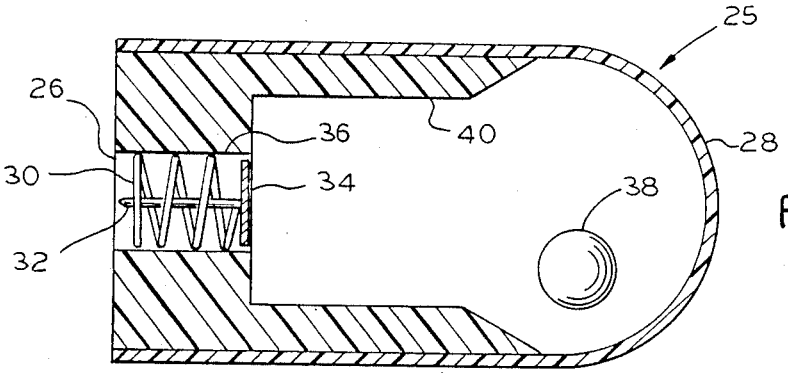
FIG. 4 is a cross section of a device for puncturing an expandable article by means of a spring biased shaft member and a freely movable weighted component.
Figure 5:
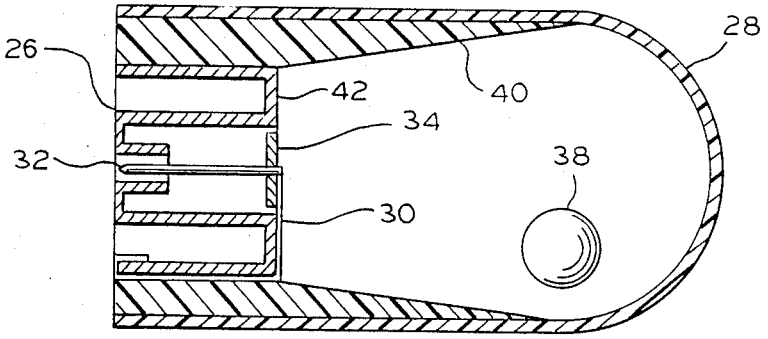
FIG. 5 is a cross section of an alternative embodiment of the spring biased shaft member shown in FIG. 4.

FIGS. 4 and 5 show in cross-section, alternative embodiments of compression spring puncturing device 25 for use in toy 10. Device 25, as shown in FIG. 4, comprises an enclosing container 28 that includes spring 30, with a shaft member 32 and bearing pad 34. Spring 30 and shaft member 32 are retained within container 28 by, for example, adhesives, friction fit or grooves, (not shown) but formed along surface 36 of support 40. Alternatively, spring 30 and shaft member 32 can be retained on pad 34 by any suitable means. Spring 30 and shaft member 32 can have any of a wide range of configurations. For example, as shown in FIG. 5, spring 30 can be provided in the form of a "U" shape which rests on pad 34. Spring 30 is attached to insert 42 fitted into support 40 by any suitable means, such as a mechanical interlocking of the components. In any event, however, spring 30 holds shaft member 32 in a retracted position away from balloon 14 until pad 34 is pressed with sufficient force to move shaft 32 toward the left in FIGS. 4 and 5 so that shaft 32 extends beyond surface 26 to puncture the balloon.

In the embodiments of FIGS. 4 and 5, a weight or ball bearing 38 is provided inside enclosure 28 for striking pad 34. A somewhat funnel shaped support 40 within enclosure 28 guides and directs ball 38 toward pad 34.

When placed in toy 10, puncturing device 25 is activated by tossing or otherwise vibrating toy !0 to cause free weight 38 to randomly impact pad 34. Random impacts of free weight 38 on, for example, circular pad 34, compresses spring 30 and moves shaft member 32 to extend beyond surface 26 to puncture article 14.

The frequency of puncturing article 14 can be selected by varying the frequency and force of the free weight's impacts upon pad 34. This can be achieved by varying the relative sizes of pad 34 and weighted component 38. As the size of pad 34 decreases relative to the size of component 38, the frequency of the impacts on pad 34 will lessen. Correspondingly, as the size of pad 34 increases relative to that of weighted component 38, the frequency of the impacts on pad 34 will increase. Similarly, if the weight of component 38 increases relative to the stiffness of spring 30, the extent of the movement of shaft 32 upon impact will increase. Thus, it is possible to tailor device 25 to achieve a desired range of movement of shaft 32 by varying the frequency and force of the impacts upon pad 34.

Figure 6:
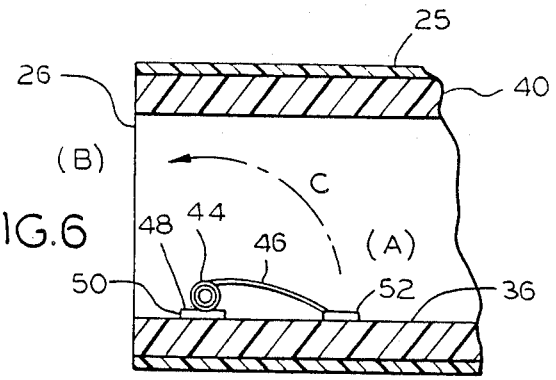
FIG. 6 is a broken cross section of a device for puncturing an expandable article by means of a spring member having an elongated arm.

The puncturing device 25 may be provided in several additional alternative embodiments, one of which is shown in FIG. 6. Device 25 includes spring member 44 having an elongated arm 46. Spring member 44 is retained on surface 48 of spring support 50 by any suitable means, such as, for example, clips. The arm 46 is placed on and is releaseably captured by a pad 52 by, for example, manually engaging arm 46 with pad 52, thus putting the spring in a first cocked position (A). Arm 46 is retained in position (A) in any suitable, and preferably repeatable way by the surface of pad 52, such as for example, adhesive or wax.

Puncturing device 25, when placed in toy 10 adjacent expandable article 14, is activated when the spring tension of arm 46 overcomes the adhesive force of pad 52. In so doing, arm 46 moves from cocked position (A) in the direction of arrow (C) to position (B) beyond surface 26 to puncture article 14. The random release of arm 46 from pad 52 imparts a highly unpredictable and amusing aspect to the play with toy 10.

Figure 7:
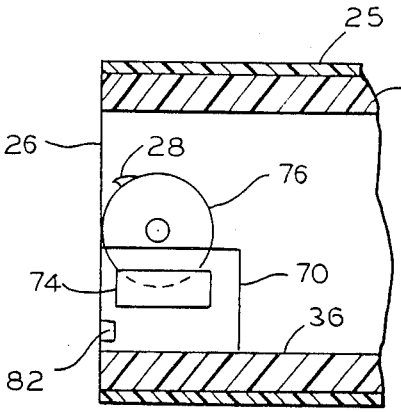
FIG. 7 is a broken cross section of a device for puncturing an expandable article by means of a rotating wheel driven by a motor apparatus.

A further alternative embodiment of puncturing device 25 is shown in FIG. 7. Device 25 includes a motor driven device 70 attached to a surface 36 of support 40. Power driven device 70 includes motor means 74 (preferably a spring driven motor) for turning wheel 76. Wheel 76 includes one or more teeth 78 which protrude beyond surface of wheel 76 and past surface 26 to puncture article 14. Teeth 78 may be distributed at random or regular intervals around the periphery of the wheel 76.

When placed in holder 12 adjacent expandable article 14, the puncturing device 25 of FIG. 7 is activated by engaging a switch means 82 to start the motor which drives gears (not shown) to cause wheel 76 to rotate. One of the teeth 78 thereafter comes into contact with and punctures expandable article 14. The random distribution of teeth 78 on wheel 76 imparts a highly unpredictable and amusing aspect to play with toy 10. On the other hand, uniform distribution of teeth, if coupled with a scale (not shown), would permit the user to turn the wheel a selected number of degrees and produce puncturing at a predetermined time.

Figure 8:
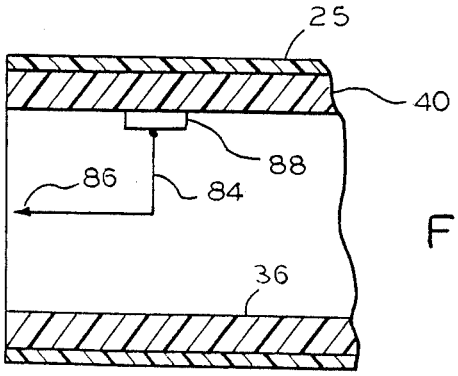
FIG. 8 is a cross section of a device for puncturing an expandable article by means of a pendulum.

FIG. 8 shows yet another embodiment of the invention, wherein a pendulum action is provided by a swinging arm 84 having a pin 86 formed on the end thereof 86. Pendulum 84 is made of spring steel and is attached at 88 to surface 36 of device 25. When placed in section 16 of holder 12, and as the toy is tossed, the pendulum 84 oscillates until the amplitude of the oscillations reach a level which is suitable to puncture the expandable object 14.

We claim:

1. A toy comprising:

holder means for retaining an expandable article;

a wheel retained by said holder so that the periphery of said wheel is in close proximity to said expandable article;

puncturing means fixed to the periphery of said wheel; and means for rotating said wheel through a variable distance, so that when said puncturing means rotates sufficiently it contacts said expandable article and causes it to burst.

2. The toy of claim 1 wherein said rotating means is a motor.

3. The toy of claim 2 wherein said motor is spring driven.

4. The toy of claim 1 wherein said puncturing means is at least one tooth.

5. The toy of claim 1 including an enclosed container connected to said holder means and housing said wheel, said container having an opening adjacent to said expandable article and of sufficient size to allow said puncturing means to protrude through said opening and puncture said expandable article.

6. A toy for puncturing an expandable article comprising:

an enclosed container for retaining said expandable article in close proximity therewith;

a rotating wheel apparatus positioned within said container, said apparatus having a puncturing portion;

means for activating said rotating wheel apparatus over a variable time period so that activation of said rotating wheel apparatus causes said puncturing portion to eventually extend beyond the surface of said container and into said article.

7. The device of claim 5 wherein said rotating wheel apparatus includes a motor means for rotating said wheel.

* * * * *